United States Patent [19]

Borst

[11] Patent Number: 4,917,261

[45] Date of Patent: Apr. 17, 1990

[54] VACUUM-FORMED CONTAINER WITH U-SHAPED LOCK

[75] Inventor: Rodney D. Borst, Oregon, Wis.

[73] Assignee: Placon Corporation, Madison, Wis.

[21] Appl. No.: 169,989

[22] Filed: Mar. 18, 1988

[51] Int. Cl.[4] ..... B65D 45/18

[52] U.S. Cl. ..... 220/324; 220/306; 220/339; 229/2.5 R

[58] Field of Search ..... 220/315, 306, 307, 324, 220/326, 339; 229/2.5 R; 292/DIG. 38, 246

[56] References Cited

U.S. PATENT DOCUMENTS

| | | | |
|---|---|---|---|
| 3,458,113 | 7/1969 | Swartzbaugh . | |
| 3,546,752 | 12/1970 | Sargent | 220/324 |
| 3,670,952 | 6/1972 | Venuti et al. . | |
| 3,730,576 | 5/1973 | Schurman | 292/246 |
| 3,747,796 | 7/1973 | Kneier et al. . | |
| 3,767,110 | 10/1973 | Congleton | 220/324 X |
| 3,786,982 | 1/1974 | Rakes et al. . | |
| 3,809,219 | 5/1974 | Esashi . | |
| 3,817,419 | 6/1974 | Moller et al. | 220/315 |
| 4,079,880 | 3/1978 | Edwards . | |
| 4,089,467 | 5/1978 | Makowicki . | |
| 4,096,986 | 6/1978 | Florian . | |
| 4,132,344 | 1/1979 | Jewell . | |
| 4,153,178 | 5/1979 | Weavers . | |
| 4,202,464 | 5/1980 | Mohs et al. . | |
| 4,314,651 | 2/1982 | Gaiser et al. | 220/326 |
| 4,523,692 | 6/1985 | Lemkin . | |
| 4,582,248 | 4/1986 | Bixler et al. . | |
| 4,592,468 | 6/1986 | Wallace . | |
| 4,602,719 | 7/1986 | Borst . | |

OTHER PUBLICATIONS

Exhibit A showing a draftsman's diagram of the Placon's camlockbox.

*Primary Examiner*—Bryan P. Gehman
*Attorney, Agent, or Firm*—Lathrop & Clark

[57] ABSTRACT

A reclosable plastic container is formed having a cover hingedly attached to a base and having an interlocking structure such that the cover is held onto the base when the container is closed. The interlocking structure includes a locking mechanism for attaching a hinged cover to the container base in a positive-manner so that the cover will not open upon impact, but may conveniently be opened and closed when required. The locking mechanism includes a locking tab hingedly connected to the cover and an outwardly extending projection formed on the base in direct alignment with the locking tab.

14 Claims, 3 Drawing Sheets

VACUUM-FORMED CONTAINER WITH U-SHAPED LOCK

BACKGROUND OF THE INVENTION

1. Field of the Invention

The present invention is generally directed to the field of packaging and containers, and particularly to plastic containers of the type having closable covers which are intended to be repeatedly closed and reopened. The present invention is specifically directed to a container having a positive locking mechanism which prevents the cover from accidentally opening when the container is dropped or impacted.

2. Description of the Prior Art

A variety of products are now commonly packaged in reclosable plastic containers with the expectation that the consumer will retain the container for a period of time to store the purchased articles. Consequently, such containers must be capable of withstanding a reasonable number of cycles of opening and closing during the expected period of use of the articles. The functioning of the container, particularly the ease by which the container may be closed and reopened, thus becomes an important factor in total consumer satisfaction.

A typical plastic container intended to hold merchandise at the point of sale has a bottom portion or base and a top portion or cover attached to the base by a hinge. Although rectangular packages are most common, the base and cover may have a variety of configurations including polygonal, round and oblong. To hold the cover to the base when the cover is closed, it is very common to provide some means for interlocking the cover and base. One type of interlocking structure is obtained by providing an upstanding shoulder about the periphery of the base which has an outwardly extending, overhanging lip. The cover has a depending wall portion with an indentation therein adapted to mate with the lip on the base so that when the cover is pressed to the base, the indentation and lip engage with each other in a "snap" fit. The engagement between the lip and indentation holds the cover and base together during normal handling but allows them to be parted when sufficient force pulling them apart is exerted.

For many containers having a secure snap-fit closure, it may be difficult or inconvenient for the user to reopen the container simply by grabbing the two halves and pulling them apart. For example, the base and cover portions may not be readily grasped by the hands of the user; the base and cover may be too large or too small or too slippery or in a shape which is difficult to hold; or under some circumstances, it may be desirable or even necessary for the user to be able to open the container using only one hand. The finger manipulation required to pull such flanges apart may also present problems to some users, such as those afflicted with arthritis.

Consequently, many of the presently available reclosable containers have some feature formed on them specifically intended to aid the user in reopening the container. For example, it is common for containers to be provided with flanges which extend outwardly from the peripheries of the base and cover portions. Usually, the flanges are formed adjacent one another but do not entirely overlap. The user may then pull the flange portion on the cover and base away from each other with his fingers to draw the cover and base apart. An example of such a container is found in U.S. Pat. No. 4,202,464 to Mohs et al.

Other containers utilize a locking mechanism in which one portion of the container, e.g., the cover, contains a hook-like piece and the other portion, for example the base, contains a co-acting latching mechanism designed to fit over the locking hook. An example may be found in U.S. Pat. No. 4,079,880 to Edwards, U.S. Pat. No. 4,314,651 to Gaiser et al. is similar to Edwards in that the lid portion is provided with an upwardly depending locking hook and the base portion is provided with a latching mechanism to fit over the hook. Similarly, U.S. Pat. No. 4,096,986 to Florian discloses a foamed plastic food tray having a cover and a base. The base has a slotted hook-like mechanism and the cover has a projecting flute with a flared out terminus designed to interact with the hook-like mechanism.

U.S. Pat. No. 4,582,248 to Bixler et al. discloses a thermoformed one-piece container in which the base portion has an outwardly depending locking hook designed to fit within a corresponding lock opening of the cover portion. Additionally, U.S. Pat. No. 3,817,419 to Moller et al. discloses a locking mechanism for a one-piece container where the lid and base portions are hingedly connected. The base portion is provided with a downwardly depending member having a locking hook, and the cover portion has a latching mechanism designed to be positively latched to the locking hook of the base portion. The cover is secured to the base by pushing the latching mechanism onto the locking hook. While these patents solve many of the problems relating to securing covers to containers, they still suffer the deficiency of being difficult to open, especially by those not mechanically adept to such practice.

In an effort to overcome some of the above-mentioned problems, U.S. Pat. No. 4,602,719 to Borst provides a reclosable plastic container in which the cover may be attached to the base by an interlocking structure having release tabs on each of the cover and base. The release tabs have camming surfaces which intersect with each other. When the tabs are pressed together, they rotate about a fulcrum created by the intersecting camming surfaces to pull the cover and base apart. While this patent represents an advance over the other prior art patents, it still suffers the deficiency of not providing a positive locking mechanism. By this, it is meant that the lock does not positively interact with a latching mechanism to prevent the cover from separating from the base if the container is dropped or impacted in some way.

SUMMARY OF THE INVENTION

It is an object of the present invention to provide a reclosable plastic container having a cover hingedly attached to a base and having an interlocking structure such that the cover is held onto the base when the container is closed.

It is also an object of the present invention to provide a locking mechanism for a plastic container which is a positive locking mechanism. By this, it is meant that the lock will not release upon impact separating the cover from the base of the container.

These and other objects are met by the present invention which is directed to a reclosable container comprising a base having peripheral edges, a cover having peripheral edges and adapted to close upon and cover the base, and at least one positive locking mechanism. The positive locking mechanism includes at least one positive locking tab hingedly extending from the peripheral edge of the cover and a locking catch extending from the base in corresponding alignment with the locking tab. The locking tab and the locking catch each have camming means formed on them which engage with each other when the locking tab is positively closed upon the locking catch. In this manner the locking tab is prevented from returning to an unlocked position because of the positive locking engagement of the locking tab onto the locking catch. By providing such a means for attaching a cover to the base of the container in a positive manner, the cover will not separate from the base upon impact. The container may still, however, be conveniently opened and closed when required.

Further objects, features and advantages of the invention will be apparent from the following detailed description when taken in conjunction with the accompanying drawings.

DESCRIPTION OF PREFERRED EMBODIMENT

Figure 1:
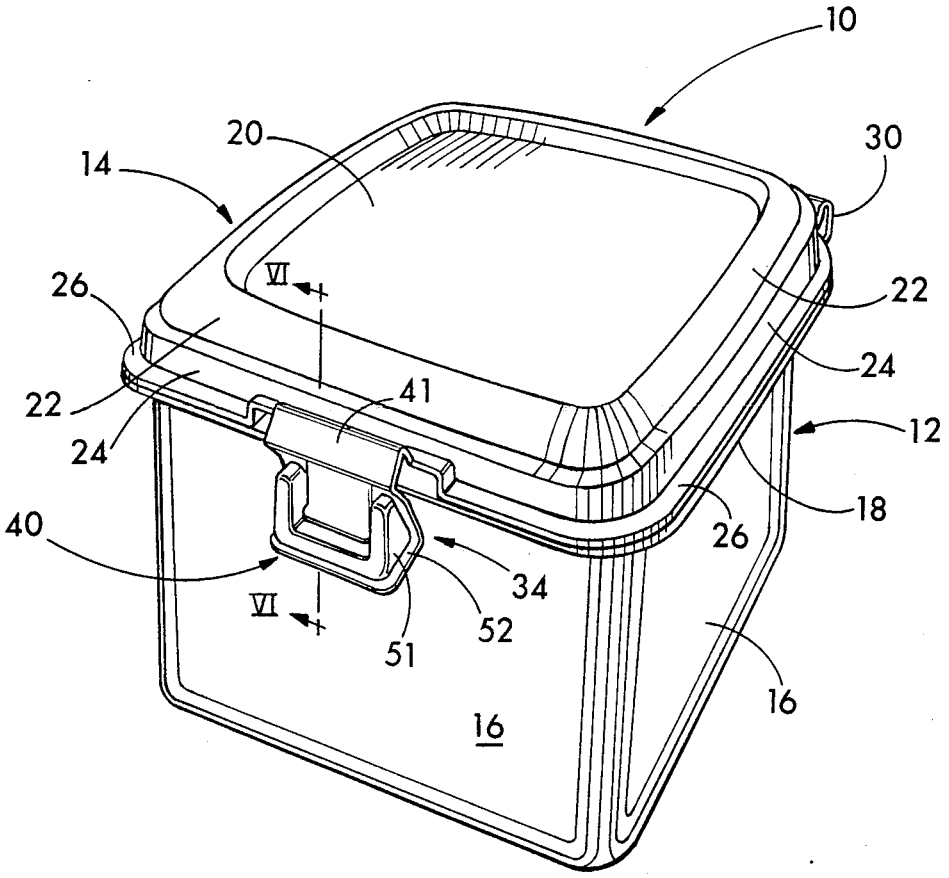
FIG. 1 is a perspective view of a reclosable container showing the improved closure mechanism of the invention.
Figure 2:
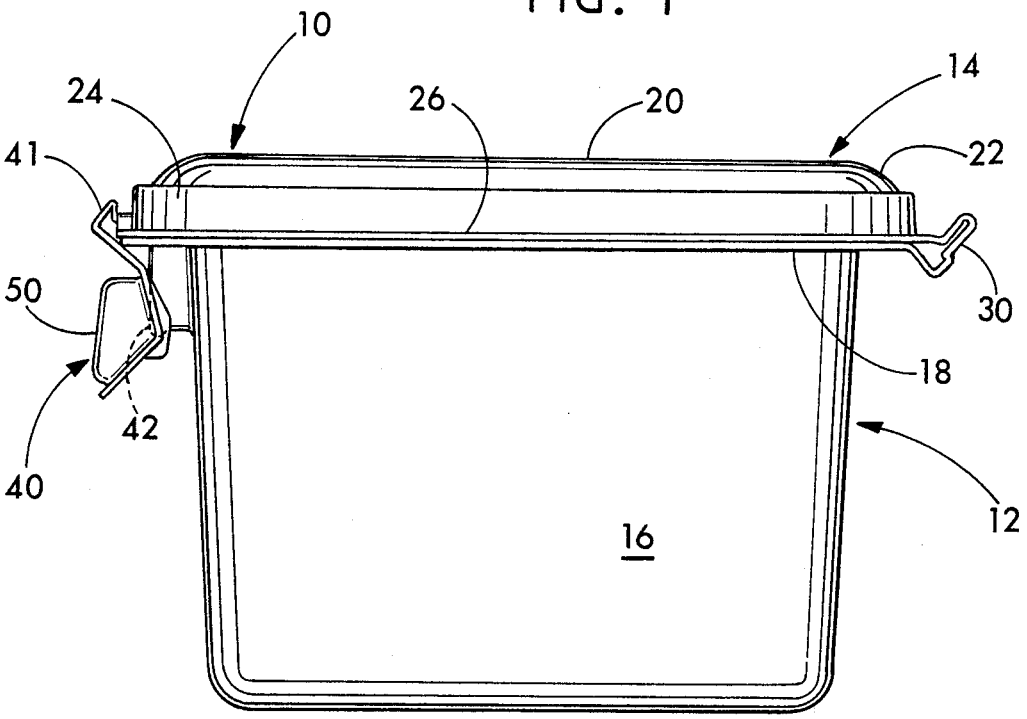
FIG. 2 is a side elevation view of the container of FIG. 1 in closed position, showing the closure mechanism in locking manner.

With reference to the drawings, a reclosable container embodying the present invention is shown generally at 10 in FIGS. 1 and 2. The container 10 is shown, for illustrative purposes, as having a substantially rectangularly or square shaped base 12 and a rectangularly shaped cover 14 which fits over and closes the open top of the base 12. Although the base and cover may have any desired configuration, for example, round, oblong, rectangular, or polygonal, the rectangular configuration shown in FIGS. 1 and 2 is particularly common. In this configuration, the base 12 has a flat bottom wall (not shown in FIG. 1) and four upright side walls 16 which are integrally connected to the bottom wall and to each other. The base side walls 16 each have an outwardly and downwardly extending rim which together forms a peripheral skirt 17 which preferably entirely surrounds the base 12. A flange 18 extends outwardly from the lower end of the skirt 17. Similarly, the cover 14 has a top wall 20 and four side walls 22 integrally connected to the top wall and to each other. Four downwardly depending skirt walls 24 are formed at the bottom of the side walls 22 and are spaced outwardly from the main portion of the side walls, preferably entirely surrounding the periphery of the cover and closely engaging the peripheral skirt 17 of the base 12 in its closed position to provide a snug closure. A flange 26 extends outwardly from the bottom edges of the skirt walls 24 around the outer periphery.

An integral hinge 30 joins the base flange 18 and the cover flange 26 along adjacent peripheral edges of the flanges and allows the cover 14 to be opened and closed about the base 12. The hinge 30 is generally formed of the same material as the base 12 and cover 14 and is integral with the base 12 and cover 14. However, the hinge material is thinner than the material making up the rest of the container thereby forming a flexible line of weakness between the base 12 and the cover 14. It is within the scope of the present invention to omit the hinge 30 and provide two or more sides of the container with a closure mechanism, or to employ a pop-together hinge with sections separately formed in the base 12 and the cover 14. Accordingly, the cover 14 may be formed of a different material than the base. The closure mechanism will be described later in this specification.

The foregoing describes structures typical of reclosable plastic containers although, as noted above, the shape of the container may be other than the rectangular shape shown. Although the container of the present invention may be made from a variety of materials commonly utilized to form containers, it is particuarly adapted to containers made of plastics which can be thermoformed from a one-piece sheet of plastic stock material. Suitable initial plastic stocks include high impact polystyrene, polyester, polyvinyl chloride, acrylonitrile butyl styrene (ABS) and acrylic copolymers. Typical sheet thickness for plastic containers may be utilized in accordance with the invention, for example, in the 20 to 50 thousandths of an inch range.

It is very important to the present invention to provide a means to positively engage the cover 14 onto the base 12 in such a manner that the cover 14 will not separate from its closed position on the base 12 when the container 10 is dropped or impacted. The hinge 30, if present, will partially prevent the cover 14 from completely separating from the base 12. However, the container 10 of the present invention is also provided with a positively locking closure mechanism, generally designated 34, which will prevent the cover 14 from inadvertently separating from the base 12 upon some impact, such as when the container 10 is accidentally dropped, and will allow the cover 14 to be easily released from the base 12 when desired. The closure mechanism 34 includes a locking tab 40 extending from a vaulted portion of the cover flange 26 by a hinge 41. The hinge 41 is generally formed of the same material as the cover 14 and is integral with the cover flange 26. However, a portion of the hinge material is thinner than the material making up the rest of the container, thereby forming a flexible line of weakness between the cover flange 26 and the remainder of the locking tab 40. The hinge 41 preferably includes a first section **41*a* extending upwardly and outwardly from the cover flange 26 to a line of weakness 41*d*, a second section 41*b* pivotally extending outwardly and downwardly from the upper end of the first section 41*a*, and a third section 41*c* extending downwardly and inwardly from the lower end of the second section 41*b* to a lower edge 48. When the locking tab 40 is in the closed position shown in FIGS. 5 and 6, the hinge third section 41*c* closely underlies the peripheral skirt 17 and the flange 18, and its engagement thereby resists any upward forces transmitted from the cover 14 to help retain the locking tab 40 in its closed position. The closure mechanism 34 also includes a corresponding locking catch 42 which is a projection formed on the side wall 16 of the base 12 in a position adjacent the locking tab 40 when the cover 14 is closed over the base 12**.

Generally, the interlocking of the base 12, and the cover 14 occurs on the wall of the container 10 opposite the hinge 30 as illustrated in FIGS. 1 and 2. The closure mechanism 34 may be placed in any of a number of positions around the periphery of the container 10. However, the most common placement is in the center of the side walls 16 and 22 opposite the hinge 30.

Referring now more specifically to FIGS. 3–6, the locking tab 40 is characterized by two downwardly depending straps 43 joined together at the ends opposite the hinge 41 by a bridging member 44. The straps 43 and the bridging member 44 define an interior opening covered by a flap 46. The flap 46 is connected to the locking tab 40 at the lower edge 48 of the hinge 41. The straps 43 and the bridging member 44 also define a U-shaped projection 50 which serves as a grasping handle.

Figure 5:
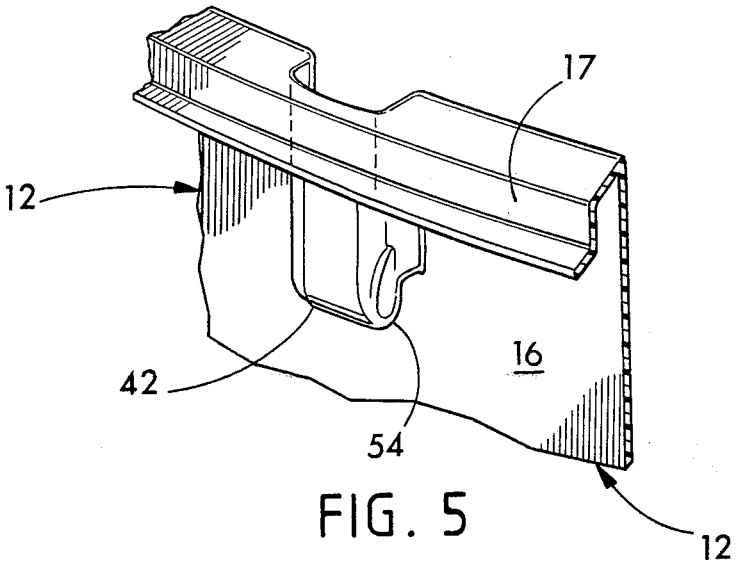
FIG. 5 is a perspective view of a partial section of the base of the container showing the locking catch of the closure mechanism.
Figure 3:
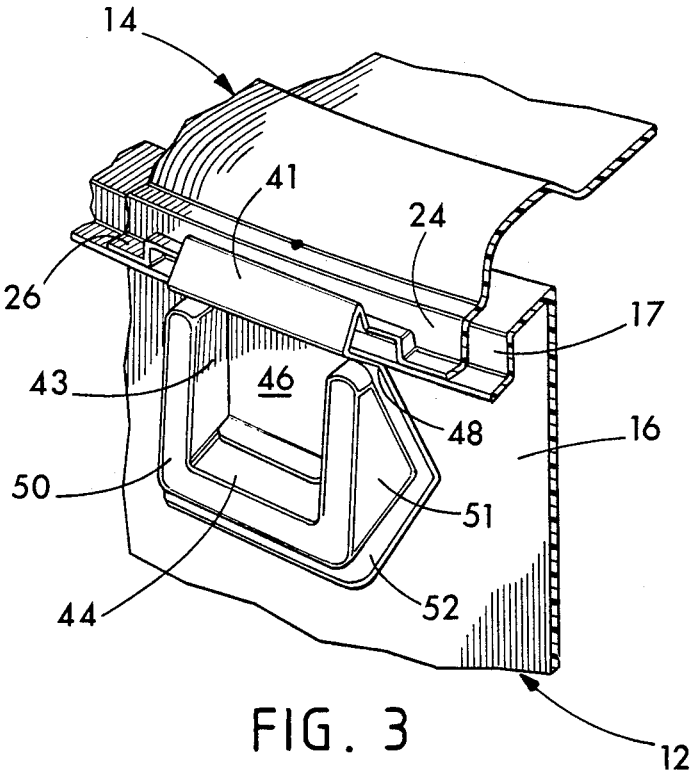
FIG. 3 is a perspective view of a section of the cover and base showing the locking tab of the closure mechanism of the present invention.
Figure 4:
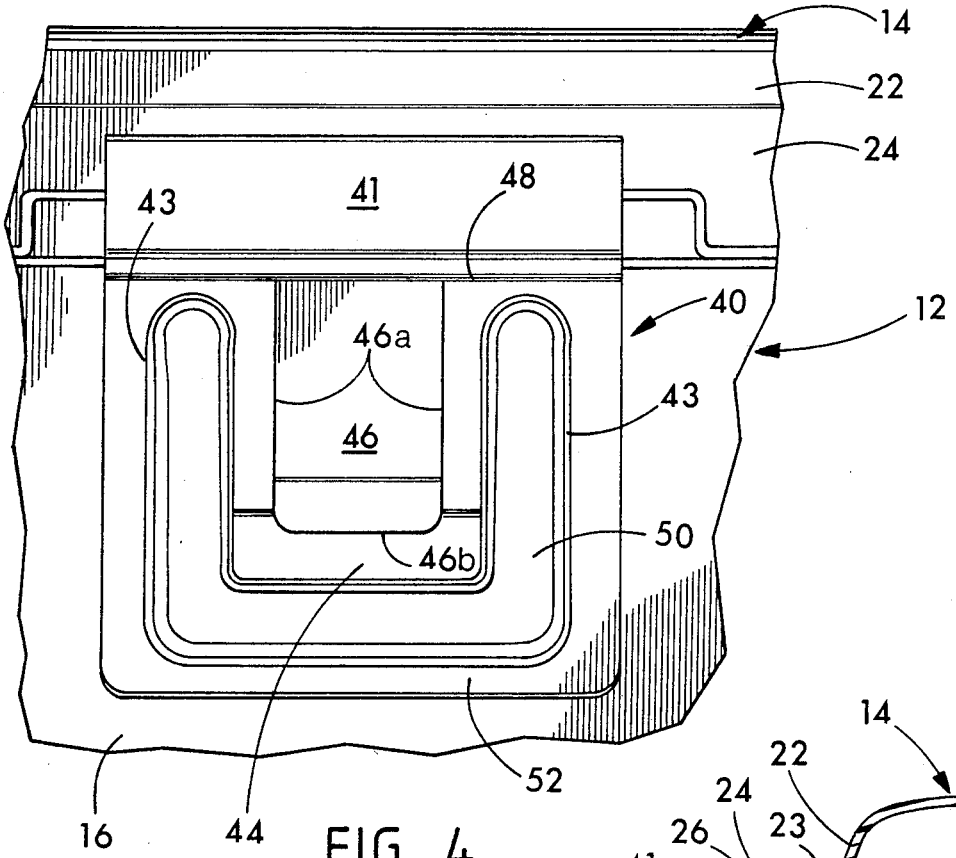
FIG. 4 is a front elevational view of the locking tab of the closure mechanism of the present invention in closed position.
Figure 6:
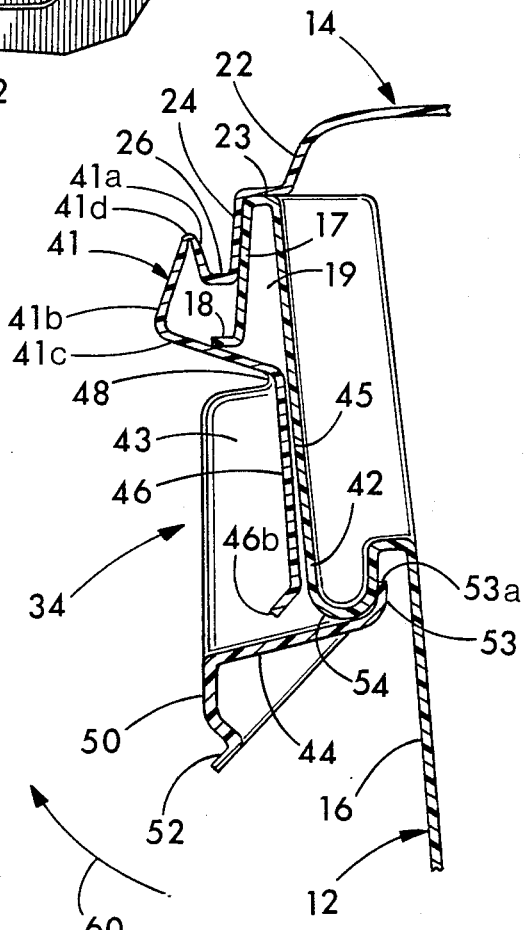
FIG. 6 is a cross-sectional view taken along section line VI—VI of FIG. 1 showing the closure mechanism of the present invention in closed position.

Located on the outer border of the bridge member 44 and the two strap projections 43 is a downwardly depending wall 51 which is bordered by an outwardly extending flange 52. The flange 52 may suitably be used as a finger grip with which to pull the locking tab 40 from a locking engagement with the locking catch 42 which is illustrated in FIGS. 5 and 6. The interior edge of the bridging member 44 is characterized by an upwardly extending camming flange 53 which, as will be more thoroughly discussed later in this specification, is designed to positively engage with the locking catch 42.

Referring now more specifically to FIGS. 5 and 6, it can be seen that the body wall 16 and the peripheral skirt 17 define a downwardly opening annular chamber 19 extending about the entire upper exterior of the side walls 16. In the vicinity of the closure mechanism 34, the projection of the locking catch 42 extends out of the side wall 16. The projection is in direct alignment with the locking tab 40 such that when the locking tab 40 closes over the projection, the cover portion 14 is in positive locking engagement with the base portion 12 of the reclosable container 10. The projection 42 is further defined by a downwardly projecting semi-cylindrical camming lip 54, as best illustrated in FIG. 6, which is designed to positively interlock with the camming flange 53 of the locking tab 40 when the cover 14 is closed down over the base 12 and the locking tab 40 is placed in interlocking engagement with the locking catch 42. Although the camming flange 53 is illustrated as being an upwardly projecting thin tab and the camming lip 54 is illustrated as being a semi-cylindrical shape, it is also possible for the camming surface to have other forms, such as a flat box-like surface or a triangular surface. Thus, any camming surfaces which allow the closure mechanism 34 to positively interlock are within the scope of the present invention.

The operation of the closure mechanism 34 is best illustrated with respect to FIG. 6. The container 10 is shown in closed position with the cover 14 sealed against the base 12 in the area designated 23 and the skirt wall 24 of the cover 14 in sealing engagement with the skirt wall 17 of the base 12. The closure mechanism 34 is also engaged as is apparent from the snap-fit connection of the camming flange 53 of the locking tab 40 onto the camming lip 54 of the locking catch 42 at a point below and inward toward the base wall 16 from the position of the cover skirt walls 24 engaged on the base skirt wall 17 in closed relation In this manner, the locking tab 40 is positively engaged with the locking catch 42. The position of the camming flange 53 relative to the camming lip 54 prevents the locking tab 40 from separating from the locking catch 42 in response to upward forces on the cover 14, which forces simply cause the camming flange 53 to more firmly engage the camming lip 54. Thus, the closure mechanism 34 will not inadvertently open. As a result, the cover 14 will remain tightly secured to the base 12.

The U-shaped locking tab 40 is preferably formed by a U-shaped die cut which defines the side edges **46*a* and lower edge 46*b* of flap 46 and the inside margin of the locking tab 40. In the unlocked or open position, the bottom edge 46*b* of the flap 46 rests adjacent the top edge 53*a* of the camming flange 53. As the locking tab 40 is closed over the locking catch 42, the flap 46 is pressed against the downwardly depending outer wall 45 of the locking catch 42 while the camming flange 53 is snapped into closed position with respect to camming lip 54. See FIG. 6. The camming flange 53 is further held in a snug-fit relationship against the camming lip 54 by the downwardly depending flap 46 which presses against the locking catch 42 in a spring-like fashion. Thus, the spring-like forces of the flap 46 exert an outward thrust upon the locking tab 40 which keeps the camming flange 53 in a snug-fit relationship with the camming lip 54. The tension created by the spring-like pressure of the flap 46 on the wall 45 of the locking catch 34 also acts to fortify the seal between the cover 14 and the base 12 at the area designated 23. Most importantly, the die cut edge 53*a* of the camming flange 53 can be located a sufficiently spaced distance from the normal plane of the bridging member 44 to provide a substantial structural engagement of the transversely extending camming flange 53 behind the camming lip 54 in positive locking relation. Accordingly, the locking catch can be designed to create a very tight seal between the cover 14 and the base 12 at area 23 because of the strong locking capability of camming flange 53 and camming lip 54, which is supplemented by the engagement of hinge third section 41*c* against flange 18**.

Even though the closure mechanism 34 provides a secure attachment for the container 10, the closure mechanism 34 may be easily opened when desired. In order to release the locking tab 40 from the locking catch 42, the locking tab is pulled along the angle dictated by the hinge 11 in the direction of the arrow 60 until the camming flange 53 passes below and becomes disengaged from the camming lip 54. The locking tab 40 may be easily pulled by the user's finger grasping the U-shaped projection 50 of the locking tab 40. Such action effectively pulls the camming flange 53 in a direction away from the base side wall 16 and outwardly from beneath the camming lip 54 and the base skirt wall 17 to permit the cover 14 to pivot about the hinge 30 to its open position. The container 10 may again be closed and positively locked by reversing the aforementioned procedures.

The present invention provides a unique container which includes a locking mechanism designed to prevent separation of the cover 14 of the container 10 from the base 12. By the positive locking action of the closure mechanism 34, the cover 14 will not separate even if the container 10 is dropped or impacted. However, the cover 14 can easily be separated simply by pulling the locking tab of the locking tab 40 from the locking catch 42 thereby disengaging the closure mechanism 34.

It is understood that the invention is not confined to the particular construction and arrangement of parts herein illustrated and described, but embraces all such modified forms thereof as come within the scope of the following claims.

What is claimed is:

1. A reclosable thermoplastic container comprising:

(a) a base having a plurality of upright side walls with a peripheral edge extending outwardly from a side wall;

(b) a cover having a peripheral edge and adapted to close upon and cover the base;

(c) a positive locking tab attached to the peripheral edge of the cover by a first hinge having a first flexible line of weakness, the locking tab including downwardly depending straps joined together by a bridging member, wherein the straps and bridging member together define a U-shaped grasping handle and the bridging member defines a first camming surface; and (d) a locking catch extending from a base side wall in corresponding alignment with the locking tab wherein the locking catch is provided with a second camming surface located substantially below and inwardly toward the base side wall from the peripheral edge which is adapted to positively engage the first camming surface of the locking tab such that when the cover is in closed position on the base, the first camming surface of the locking tab engages the second camming surface of the locking catch to prevent the locking tab from returning to an unlocked position without assistance; and wherein a section of the hinge closely underlies the base peripheral edge, when the first and second camming surfaces are engaged, to resist upward forces transmitted from the cover.

2. The container according to claim 1 wherein the cover has a top wall and side walls extending therefrom which are integrally connected together and wherein the base has a bottom wall and said base side walls extend therefrom and are integrally connected together.

3. The container according to claim 1 wherein the base peripheral edge has an outwardly and downwardly extending rim forming a peripheral skirt with a base flange extending outwardly therefrom, and wherein the hinge section closely underlies the peripheral skirt and base flange.

4. The container according to claim 1 wherein the first flexible line of weakness defining the first hinge is formed of a plastic material which is integral with but thinner than the plastic materials adjacent the first flexible line of weakness.

5. The container according to claim 1 wherein the cover, base, locking tab and locking catch are integrally formed and the cover is attached at a peripheral edge to the base by a second flexible line of weakness to form a second hinge.

6. The container according to claim 1 wherein the cover, base, locking tab and locking catch are integrally vacuum formed of a plastic material selected from the group consisting of polystyrene, acrylic copolymer, polyvinyl chloride, ABS, and polyester.

7. The container according to claim 1 wherein the base peripheral edge has an outwardly and downwardly extending rim forming a peripheral skirt and wherein the second camming surface of the locking catch is located below and inwardly toward the base wall from the peripheral skirt.

8. The container according to claim 1 wherein the locking tab includes a spring-like flap which presses against an outwardly facing wall of the locking catch to effect a snug-fit relationship between the first camming surface and the second camming surface.

9. A one-piece reclosable thermoplastic container comprising:

(a) a base having a bottom wall and side walls extending upwardly therefrom, and peripheral edges extending outwardly from the base side walls;

(b) a cover having peripheral edges wherein one edge of the cover is connected to one edge of the base by a flexible line of weakness forming a cover hinge such that the cover may close upon and cover the base; and (c) a closure mechanism for positively engaging the cover to the base, the closure mechanism comprising a locking tab attached to a peripheral edge of the cover by a locking hinge having a flexible line of weakness, wherein the locking tab includes a U-shaped grasping handle containing two downwardly depending parallel straps joined together at the end opposite the peripheral edge of the cover by a bridging member, the bridging member including a first camming surface; the closure mechanism further comprising a locking catch extending from a base side wall in corresponding alignment with the locking tab, wherein the locking catch is provided with a second camming surface located substantially below and inwardly toward the base side wall from a base peripheral edge which is adapted to positively engage the first camming surface of the locking tab, such that when the cover is in closed position on the base, the first camming surface of the locking tab engages the second camming surface of the locking catch to prevent the locking tab from disengaging from the locking catch without user assistance because of the engagement of the locking tab onto the locking catch, the locking tab further comprising a spring-like flap which presses against the locking catch to effect a snug-fit relationship between the first camming surface and the second camming surface.

10. The container according to claim 9 wherein the cover has a top wall and side walls extending therefrom which are integrally connected together and wherein the base side walls are integrally connected together.

11. The container according to claim 9 wherein the cover, base, locking tab and locking catch are integrally vacuum formed of a material selected from the group consisting of polystyrene, acrylic copolymer, polyvinyl chloride, ABS, and polyester.

12. The container according to claim 9 wherein the base peripheral edge has an outwardly and downwardly extending rim forming a peripheral skirt and wherein the second camming surface of the locking catch is located below and inwardly toward the base from the peripheral skirt.

13. A reclosable container of thin flexible thermoformed plastic material comprising:

(a) a base having a plurality of side walls with a peripheral edge extending outwardly from a side wall;

(b) a cover having peripheral edges and adapted to close upon and cover the base;

(c) a positive locking tab attached to a peripheral edge of the cover by a first hinge having a first flexible line of weakness, the locking tab including downwardly depending straps joined together by a bridging member, wherein the straps and bridging member together define a U-shaped grasping handle, the bridging member having a transversely extending first camming surface which terminates at a die cut edge;

(d) a locking catch extending from a base side wall in corresponding alignment with the bridging member of the locking tab wherein the locking catch is provided with a second camming surface located substantially below and inwardly toward the base side wall from a base peripheral edge which is adapted to positively engage the first camming surface of the locking tab such that when the cover is in closed position on the base, the first camming surface of the locking tab engages the second camming surface of the locking catch to prevent the locking tab from returning to an unlocked position without assistance; and (e) wherein the base peripheral edge has an outwardly and downwardly extending rim forming a peripheral skirt, and wherein a section of the hinge closely underlies the peripheral skirt when the first and second camming surfaces are engaged to resist upward forces transmitted from the cover.

14. A reclosable container of thin flexible thermoformed plastic material comprising:

(a) A base having a plurality of side walls with a peripheral edge extending outwardly from a side wall;

(b) A cover having peripheral edges and adapted to close upon and cover the base;

(c) A positive locking tab attached to a peripheral edge of the cover by a first hinge having a first flexible line of weakness, the locking tab including downwardly depending straps joined together by a bridging member, wherein the straps and bridging member together define a U-shaped grasping handle, the bridging member having a transversely extending first camming surface which terminates at a die cut edge;

(d) A locking catch extending from a base side wall in corresponding alignment with the bridging member of the locking tab wherein the locking catch is provided with a second camming surface located substantially below and inwardly toward the base side wall from a base peripheral edge which is adapted to positively engage the first camming surface of the locking tab such that when the cover is in closed position on the base, the first camming surface of the locking tab engages the second camming surface of the locking catch to prevent the locking tab from returning to an unlocked position without assistance; and (e) wherein the locking tab includes a spring-like flap which presses against an outwardly facing wall of the locking catch to effect a snug-fit relationship between the first camming surface and the second camming surface.

* * * * *